US005255898A

United States Patent [19]

Cacicedo

[11] Patent Number: 5,255,898

[45] Date of Patent: Oct. 26, 1993

[54] METAL FASTENING APPARATUS FOR FASTENING METAL WIRE MESH TO METAL POLES

[76] Inventor: Paulino A. Cacicedo, 5 Tisbury Ct., Scotch Plains, N.J. 07076

[21] Appl. No.: 728,871

[22] Filed: Jul. 16, 1991

Related U.S. Application Data

[63] Continuation-in-part of Ser. No. 523,482, May 15, 1990, abandoned, which is a continuation-in-part of Ser. No. 398,932, Aug. 28, 1989, abandoned, which is a continuation-in-part of Ser. No. 318,018, Mar. 2, 1989, abandoned.

[51] Int. Cl.[5] ..... E04H 17/04

[52] U.S. Cl. ..... 256/47; 256/48; 256/54; 411/480

[58] Field of Search ..... 256/47, 48, 58, DIG. 5, 256/49, 52–54, 33, 32, 1; 411/480–482, 484, 485, 456, 469, 481, 388, 923

[56] References Cited

U.S. PATENT DOCUMENTS

| | | | |
|---|---|---|---|
| 490,403 | 1/1893 | Schofield | 256/54 |
| 870,443 | 11/1907 | LaVoie | 256/54 X |
| 987,485 | 3/1911 | Peterson | 256/54 |
| 1,360,375 | 11/1920 | Dammann | 256/54 |
| 2,067,359 | 1/1937 | Tumminello | 256/54 X |

FOREIGN PATENT DOCUMENTS

| | | | |
|---|---|---|---|
| 1078088 | 11/1954 | France | 411/388 |
| 16732 | of 1889 | United Kingdom | 411/480 |

*Primary Examiner*—Randolph A. Reese
*Assistant Examiner*—Harry C. Kim
*Attorney, Agent, or Firm*—R. Gale Rhodes, Jr.

[57] ABSTRACT

Fastening apparatus for fastening metal wire mesh made of interwoven strands of metal wire of generally circular cross-section to a metal pole including metal wire mesh engaging member for engaging at least one of the strands of metal wire and a metal nail-like member including a shank provided with removal resisting structure such as ridges or barbs and for being driven into the metal pole upon sufficient force being applied thereto to cause the metal wire mesh engaging member to at least partially encircle one of the strands of metal wire to fasten the metal wire mesh to the metal pole, the removal resisting structure for resisting removal of the shank from the metal pole.

9 Claims, 8 Drawing Sheets

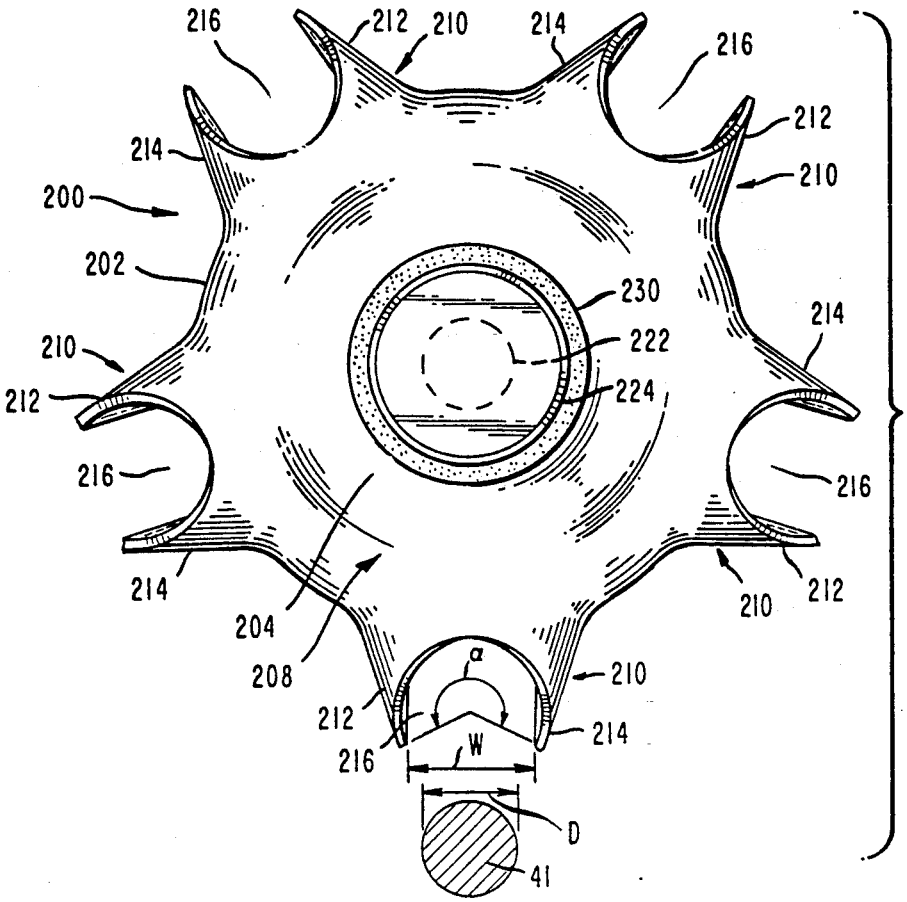
FIG.29
FIG. 30
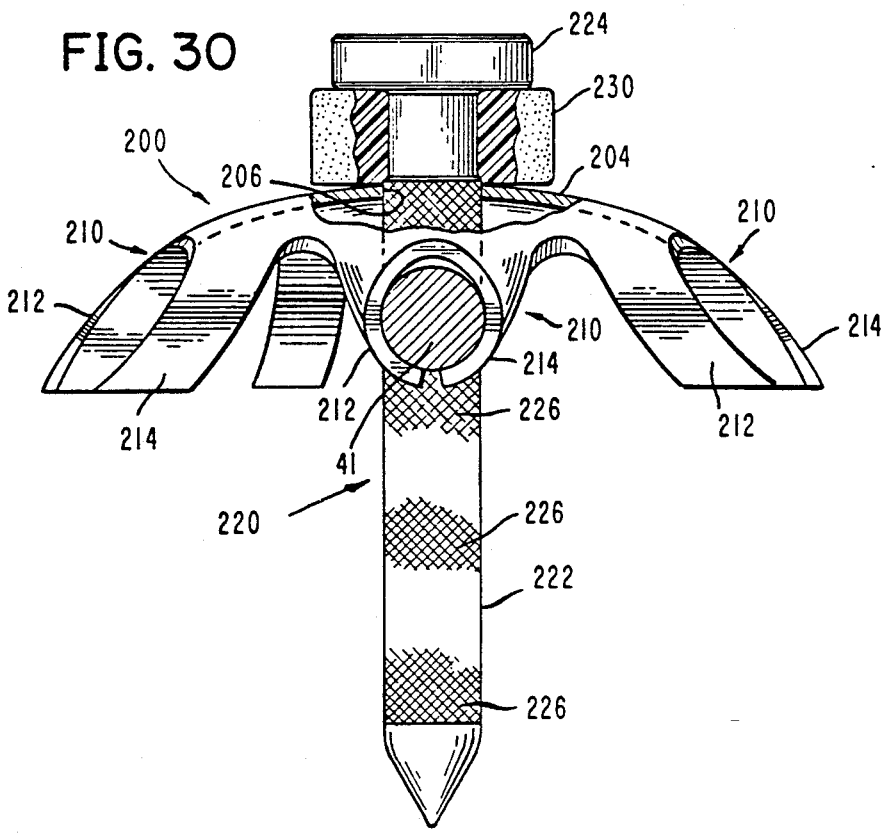

METAL FASTENING APPARATUS FOR FASTENING METAL WIRE MESH TO METAL POLES

CROSS-REFERENCE TO RELATED APPLICATIONS

This application is a continuation-in-part of U.S. patent application Ser. No. 523,482 filed May 15, 1990 by Paulino A. Cacicedo entitled METAL FASTENING APPARATUS FOR FASTENING METAL WIRE MESH TO METAL POLES (now abandoned) which is a continuation-in-part application of U.S. patent application Ser. No. 398,932 filed Aug. 28, 1989 by Paulino A. Cacicedo entitled METAL FASTENING APPARATUS FOR FASTENING METAL WIRE MESH TO METAL POLES (now abandoned) which is a continuation-in-part application of U S. patent application Ser. No. 318,018 filed Mar. 2, 1989 by Paulino A. Cacicedo entitled METAL FASTENING APPARATUS F0R FASTENING METAL WIRE MESH TO METAL POLES (now abandoned).

BACKGROUND OF THE INVENTION

This invention relates generally to new and improved metal fastening apparatus for fastening metal wire mesh to metal poles.

As known to those skilled in the fence art, fences comprised of metal wire mesh fastened to metal poles are well known for fencing people and/or animals out of a certain area and for fencing people and/or animals inside of a certain area. Such prior art metal fences, as is further known, include fastening apparatus for fastening the metal wire mesh to the metal poles such as metal ties, metal clamps, etc. As is still further known, such prior art fastening means suffer from the general disadvantage that they are subject to unwanted removal to open or tear down the fence by diligent and repeated manual efforts particularly by people with or without the aid of tools such as pliers, screw drivers, etc. Accordingly, there exists a need in the metal fence art for new and improved fastening means for fastening metal wire mesh to the metal poles and which new and improved fastening means substantially resist the above-noted removal efforts.

SUMMARY OF THE INVENTION

The primary object of the present invention is to satisfy the above-noted need in the metal fence art.

Fastening apparatus fulfilling such object and embodying the present invention may include fastening apparatus for fastening metal wire mesh to a metal pole, the metal wire mesh made of interwoven strands of metal wire of generally circular cross-section, such fastening apparatus includes a metal wire mesh engaging member for engaging at least one of the strands of metal wire, a metal nail-like member including a shank provided with removal resisting means and for being driven into the metal pole upon sufficient force being applied thereto to cause the metal wire mesh engaging member to at least partially encircle one of the strands of metal wire to fasten the metal wire mesh to the metal pole, and the removal resisting means for resisting removal of the shank from the metal pole.

DESCRIPTION OF THE DRAWINGS

FIG. 29 is a top view of the metal fastening apparatus of FIG. 28; and

FIG. 30 is a partial cross-sectional assembly view illustrating the assembly of the metal fastening apparatus of FIGS. 28 and 29 and a metal nail-like member and which figure illustrates the manner in which a pair of curved and downwardly extending members of the metal fastening apparatus of FIGS. 28 and 29 is deformed and wrapped around and substantially totally encircles a strand of metal wire to fasten metal wire mesh to a metal pole.

DESCRIPTION OF THE PREFERRED EMBODIMENTS

Figure 1:
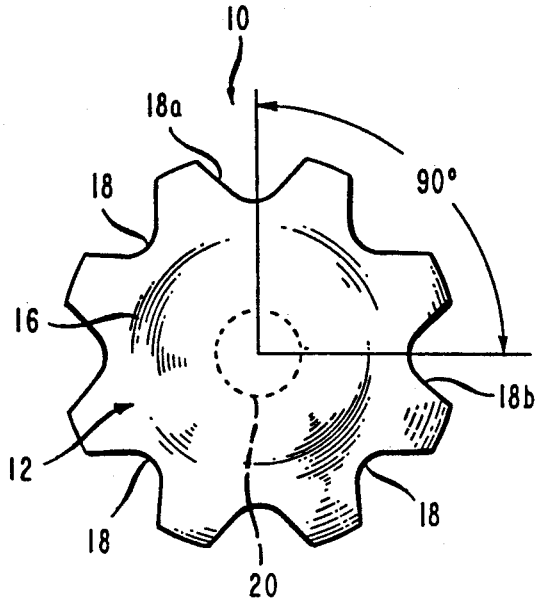
FIG. 1 is a top view of the metal fastening apparatus embodying the present invention.
Figure 2:
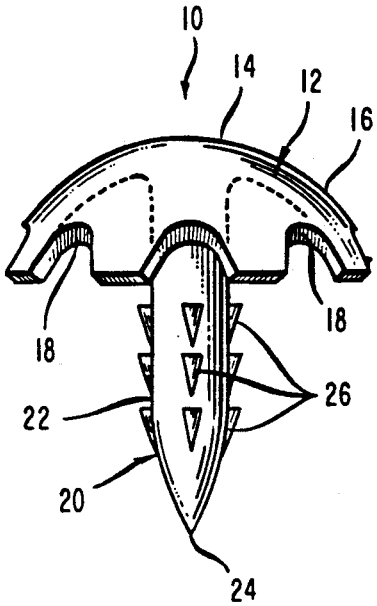
FIG. 2 is a side view of the metal fastening apparatus of FIG. 1.

Referring now to FIGS. 1 and 2, there is shown metal fastening apparatus embodying the present invention and identified by general numerical designation 10. Generally, it will be understood that the metal fastening apparatus 10 is for fastening metal wire mesh indicated by general numerical designation 40 in FIG. 3 to a metal pole such as the metal pole indicated by general numerical designation 30 in FIGS. 3 and 4. Metal fastening apparatus 10 includes a metal wire engaging member for engaging at least one strand of the mesh and which member may be the generally semi-hemispherical shell-like metal member indicated by general numerical designation 12 including a top central portion 14 and a downwardly extending skirt portion 16. Skirt portion 16 is provided with a plurality of generally inwardly and upwardly extending semi-circular indentations 18 displaced circumferentially around the skirt portion 16 as may be best seen in FIG. 1.

Metal fastening apparatus 10, and as may be best seen in FIG. 2, further includes a metal nail-like member indicated by general numerical designation 20 including a shank 22 extending downwardly generally centrally interiorly of the skirt portion 16 and terminating in a point 24. The shank 22 may be provided with a plurality of outwardly extending barbs 26 for resisting removal of the shank 22 and thereby removal of the metal fastening apparatus 10 from a metal pole, such as metal pole 30 shown in FIGS. 3 and 4, upon the metal fastening apparatus being fastened to the pole by sufficient force being applied to the shank 22 through the top central portion 14 of the skirt portion 16 by suitable means, such as for example a pneumatic hammer, etc., to drive the shank 22 into the metal pole 30 as shown in FIG. 4.

Figure 3:
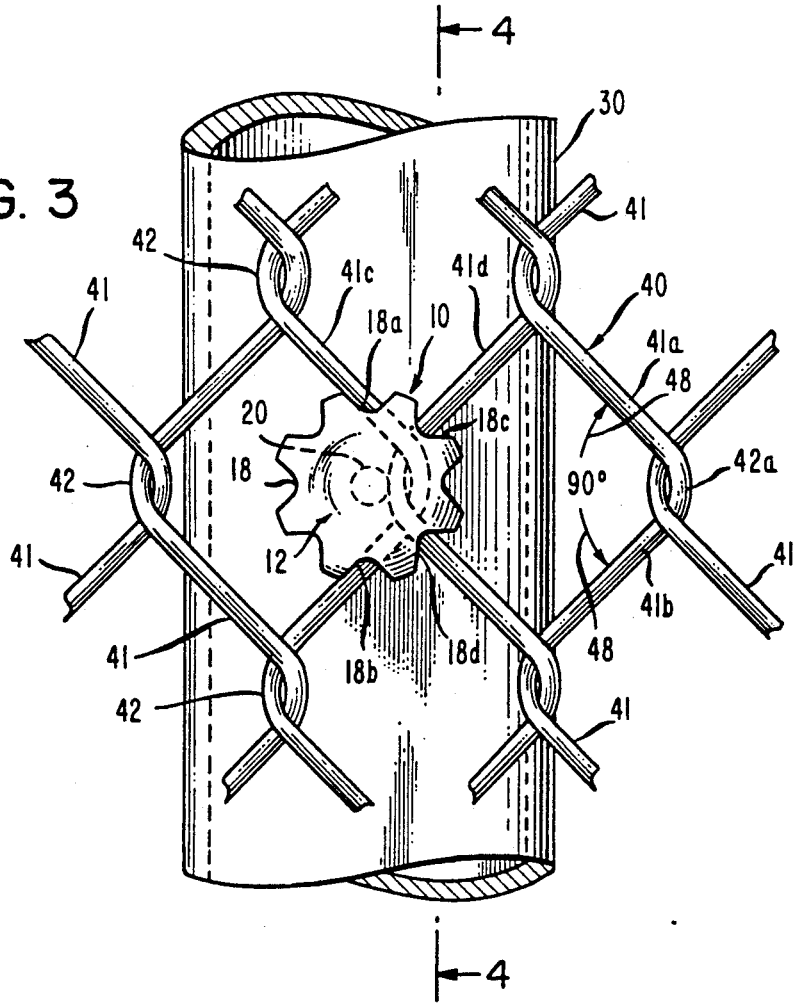
FIG. 3 is a generally front elevational view illustrating the fastening of metal wire mesh to a metal pole by the metal fastening apparatus of the present invention.
Figure 4:
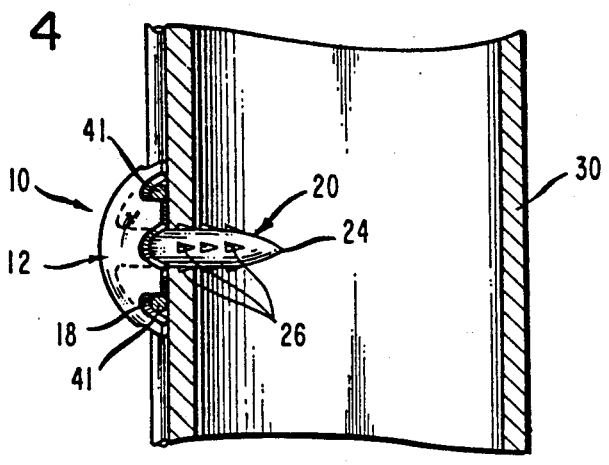
FIG. 4 is a side elevational view with a part of the metal pole partially broken away to illustrate in greater detail the fastening of the metal wire mesh to the metal pole by the metal fastening apparatus of the present invention.

Referring now to FIG. 3, it will be noted that the metal wire mesh 40 is comprised of a plurality of strands of metal wire 41 of generally cross-sectional configuration, as shown in FIG. 4, which metal strands 41 are interwoven at intersections 42, FIG. 3, to form the metal wire mesh 40 and wherein the strands of metal wire 41, such as strands 41*a* and 41*b*, extend outwardly from an intersection, e.g. intersection 42*a*, and are displaced from each other by substantially 90° as indicated by the double-headed arcuate arrow 48.

Referring again to FIG. 1, and in accordance with the further teachings of the present invention, it will be understood that the indentations 18 are displaced circumferentially around the skirt 16 such that ones or pairs thereof, for example indentations 18*a* and 18*b*, are displaced from each other by substantially 90° as indicated by the double-headed arcuate arrow 49.

Accordingly, it will be still further understood in accordance with the teachings of the present invention, and referring particularly to FIG. 3, that upon the metal fastening apparatus 10 being suitably rotated a plurality of indentations 18 will receive and partially surround a plurality of metal wire strands 41 comprising the metal wire mesh 40 and upon the above-noted sufficient force being applied to the metal shank 22, a plurality of wire strands 41 are fastened to the metal pole 30 to enhance fastening of the metal wire mesh 40 to the metal pole.

Figure 5:
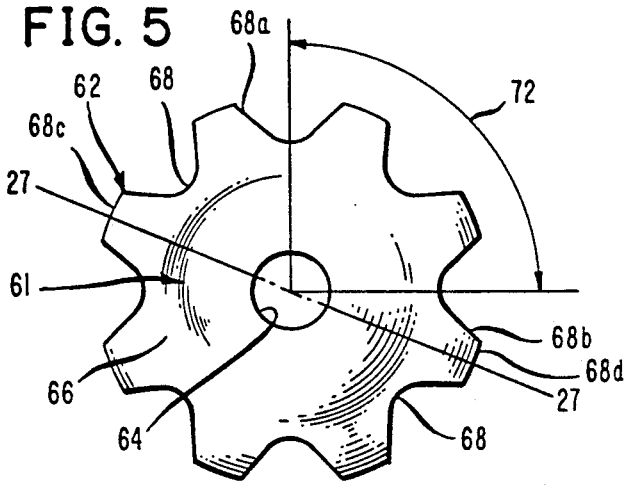
FIG. 5 is a top view of a metal skirt member comprising an alternate embodiment of the metal fastening apparatus of the present invention.
Figure 6:
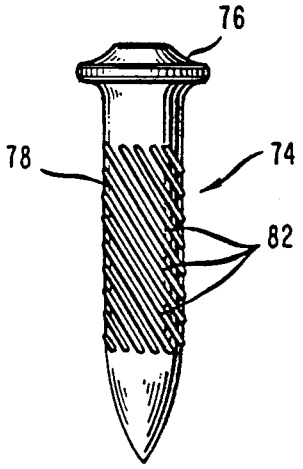
FIG. 6 is an elevational view of a metal nail-like member comprising the alternate embodiment of the metal fastening apparatus of the present invention.
Figure 7:
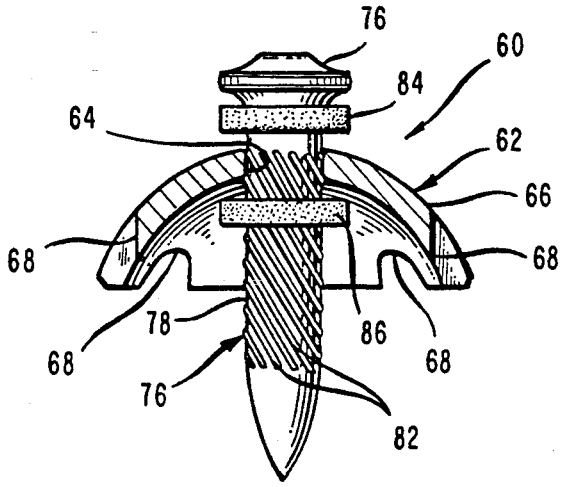
FIG. 7 is a partial cross-sectional assembly view illustrating the assembly of the metal skirt member of FIG. 5 and the metal nail-like member of FIG. 6 according to the present invention.

Referring now to FIGS. 5–7, an alternate embodiment of metal fastening apparatus embodying the present invention is shown and identified in FIG. 7 by general numerical designation 60. Alternate embodiment 60 includes a metal wire mesh engaging member for engaging at least one strand of the mesh and which member may be the generally semi-hemispherical shell-like metal member indicated by general numerical designation 62 in FIGS. 5 and 7. Member 62 includes a central top portion indicated by general numerical designation 61 provided with a hole 64 and a downwardly extending skirt portion 66 provided with a plurality of generally inwardly and upwardly extending indentations 68 displaced circumferentially around the skirt portion 66. It will be understood that indentations 68, in the same manner as indentations 18 illustrated in FIG. 1, are displaced circumferentially around the skirt 66 such that ones or pluralities thereof, e.g. indentations 68*a* and 68*b*, are displaced from each other by substantially 90° as indicated by double-headed arcuate arrow 72. Metal fastening apparatus alternate embodiment 60 further includes a metal nail-like member indicated by general numerical designation 74 in FIGS. 6 and 7; metal nail-like member 74 includes a shank 78 for being inserted downwardly through the hole 64 provided in the metal member 62 as shown in FIG. 7, and is for extending downwardly generally centrally interiorly of the skirt portion 66. Metal nail-like member 74 includes a head 76, larger than hole 64 (FIG. 5) and shank 78 may be provided with scoring producing outwardly extending ridges 82 for resisting removal of the shank 78 from a metal pole, such as metal pole 30 of FIGS. 3 and 4, upon the shank being driven into the metal pole in the manner described above with regard to shank 22 of metal fastening apparatus 10.

Further, metal fastening apparatus alternate embodiment 60 may further include one or more plastic washers, e.g. plastic washers 84 and 86, FIG. 7. As illustrated in FIG. 7, plastic washer 80 encircles the shank 74 and is positioned between the head 76 of the metal nail-like member 74 and the top central portion of the shell-like member 62 and plastic washer 86 encircles the shank 74 and is disposed underneath the top central portion of the shell-like metal member 62.

Generally, and in brief review, it will be understood that metal fastening apparatus 10 embodying the present invention and illustrated in FIGS. 1 and 2 is an integrally formed metal fastening apparatus including integrally formed generally semi-hemispherical shell-like metal member 12 and metal nail-like member 20 which members may be formed integrally by a suitable metal molding process known to the art; the metal fastening apparatus 10 may be made of a suitable stainless steel. Alternate metal fastening apparatus 60 embodying the present invention and illustrated in FIGS. 5–7 is comprised of physically distinct or separate generally semi-hemispherical shell-like metal member 62 and nail-like member 74 described above and assembled as illustrated in FIG. 7; the members 62 and 74 may be made by a suitable metal molding process, or other suitable metal forming process, known to the art and may be made of a suitable metal such as stainless steel.

Reference is now made to FIGS. 8–13 wherein alternate embodiments of the generally semi-hemispherical shell-like metal member shown in FIGS. 5 and 7 are illustrated. It will be understood that these alternate embodiments comprise metal wire mesh engaging members for engaging at least one strand of the metal wire mesh which alternate embodiments in combination with the metal nail-like member 74 shown in FIGS. 6 and 7 comprise alternate embodiments of the fastening apparatus of the present invention; such combinations may further comprise one or more of the plastic washers 84 and 86.

Figure 8:
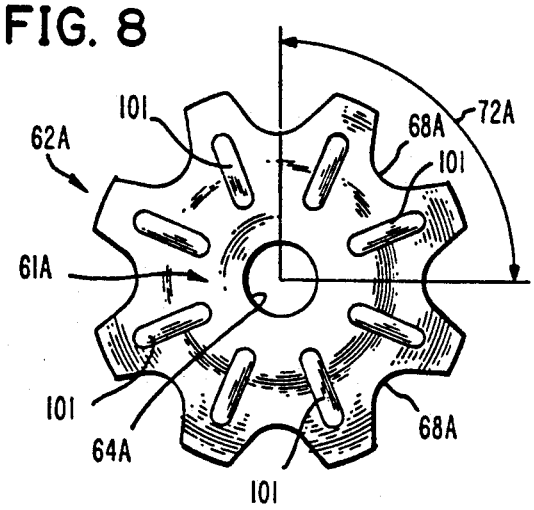
FIGS. 8–13 are top views of alternate embodiments of metal skirt members comprising alternate embodiments of metal fastening apparatus of the present invention for use with a metal nail-like member shown in FIG. 6.

Referring specifically to FIG. 8, there is illustrated the alternate generally semi-hemispherical shell-like metal member 62A which is substantially the same as generally semi-hemispherical shell-like member 62 of FIGS. 5 and 7 except that the central top portion 61A is provided with a plurality of upwardly extending radially disposed reinforcing ridges 101 for structurally reinforcing the generally semi-hemispherical shell-like member 62A; other structural features of this member 62A corresponding to structural features of member 62 of FIGS. 5 and 7 are given the same numerical designations plus the additional alphabetical designation A.

Figure 9:
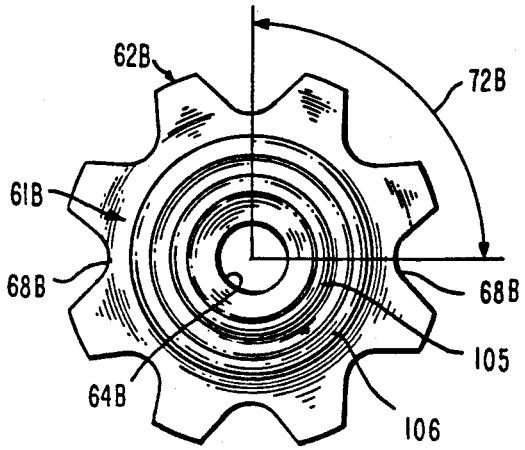

In FIG. 9, the alternate generally semi-hemispherical shell-like member 62B includes a central top portion 61B provided with concentric upwardly extending reinforcing ribs or ridges 105 and 106 for structurally reinforcing the member 62B; other structural features of this member 62B corresponding to structural features of member 62 of FIGS. 5 and 7 are given the same numerical designation plus the additional alphabetical designation B.

Figure 10:
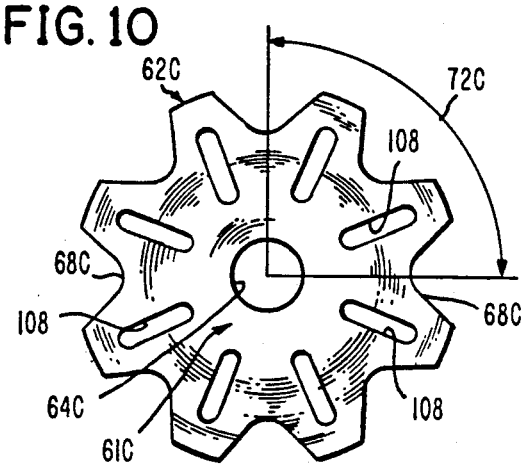

In FIG. 10, the central top portion 61C of the generally semi-hemispherical shell-like member 62C is provided with a plurality of radially disposed, generally longitudinally extending openings or holes 108 to facilitate deformation of the generally semi-hemispherical shell-like member 62C in those applications where it is found to be desirable, if not required, to enhance the deformability of the member 62C and enhance its engagement with the wire strands 41 of the metal wire mesh 40 (FIG. 3) and thereby enhance the fastening of the metal wire mesh to the metal pole, e.g. metal pole 30 of FIG. 3; other structural features of this member 62C corresponding to the structural features of member 62 of FIGS. 5 and 7 are given the same numerical designations plus the additional alphabetical designation C.

Figure 11:
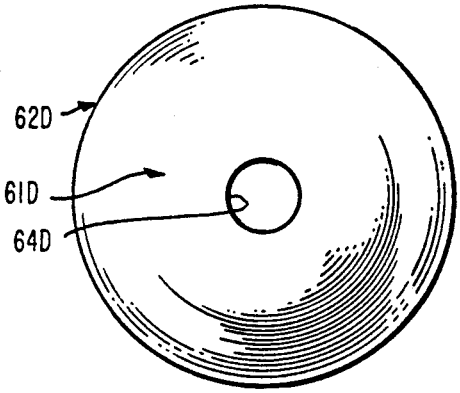
Figure 13:
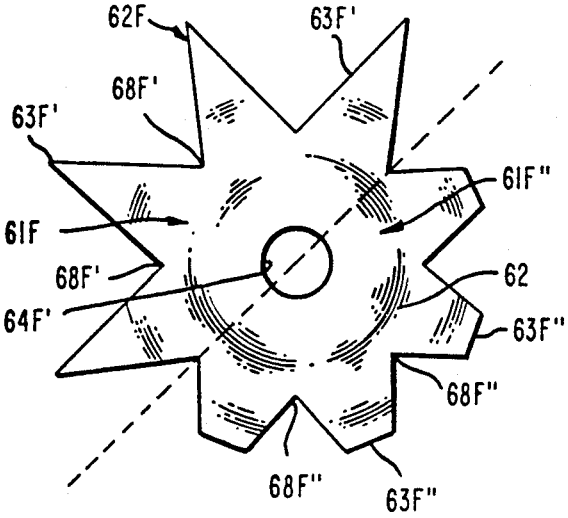

The alternate generally semi-hemispherical shell-like member 62D of FIG. 11 is continuous and not provided with any indentations, such as indentations 68 of FIG. 5, and in this embodiment the generally semi-hemispherical underneath portion of the alternate member 62D is utilized to receive and at least partially engage one or more of the strands of metal wire 41 of the metal wire mesh 40 (FIG. 3) to fasten the metal wire mesh to a metal pole such as pole 30 of FIG. 3; other structural features of this member 62D corresponding to structural features of member 62 of FIGS. 5 and 7 are given the same numerical designation plus the additional alphabetical designation D.

Figure 12:
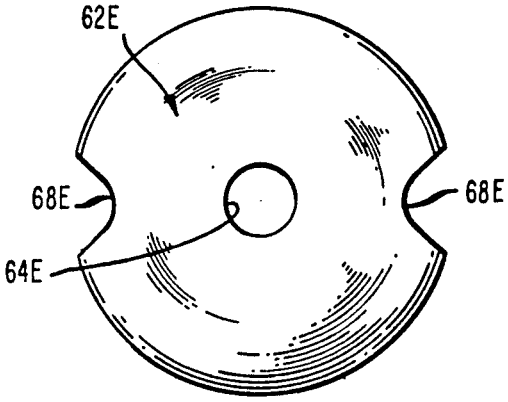

The alternate generally semi-hemispherical shell-like member 62E of FIG. 12 is substantially the same as member 62 of FIGS. 5 and 7 except that in this embodiment only two generally inwardly and upwardly extending indentations 68E—68E are provided. Otherwise, embodiment 62E functions substantially the same as embodiment 62 of FIGS. 5 and 7.

Alternate embodiment 62F of FIG. 13 again is substantially the same as embodiment 62 of FIGS. 5 and 7 except that, as illustrated in the split views (the views 61F' and 61F'' of the top central portion 61F being split by the diagonal line 107), the top central portion 61F' is comprised of a plurality of downwardly extending triangular members 63F' terminating in a point and providing therebetween generally inwardly and upwardly extending triangular indentations 68F' for receiving and at least partially encircling one or more of the strands of metal wire 41 (FIG. 3) for fastening the metal wire mesh 40 to a metal pole such as pole 30 of FIG. 3; the top central portion 61F'' is substantially the same as 61F' but comprises a plurality of downwardly extending truncated triangular members 63F'' providing therebetween a plurality of generally inwardly and upwardly extending triangular indentations 68F'' which function the same as indentations 68F'.

Alternate embodiment of metal wire mesh engaging members which in combination with the metal nail-like member 74 (FIG. 6) comprise further alternate embodiments of the metal fastening apparatus of the present invention are illustrated in FIGS. 14–19; these alternate embodiment metal wire mesh engaging members are also for engaging at least one of the strands 41 (FIG. 4) of the metal wire mesh 40 to fasten the metal wire mesh 40 to a pole, such as pole 30 of FIG. 3, upon the metal nail-like member 74 (FIG. 6) being inserted through the holes shown therein and driven into engagement with the metal pole as described above.

Figure 14:
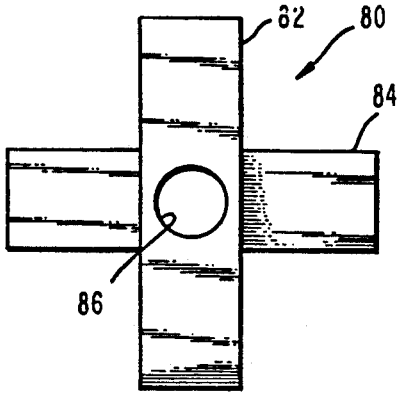
FIGS. 14–19 are alternate embodiments of metal wire mesh engaging members comprising in combination with the metal nail-like member of FIG. 6 alternate embodiments of metal fastening apparatus of the present invention.
Figure 15:
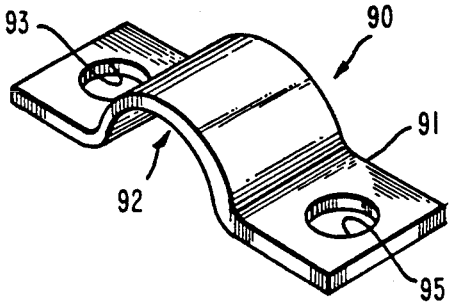
Figure 16:
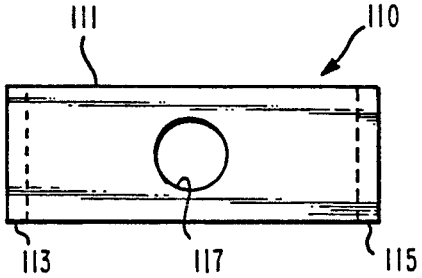
Figure 18:
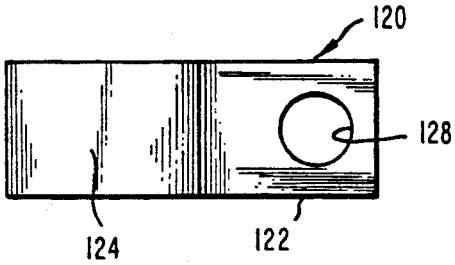
Figure 17:
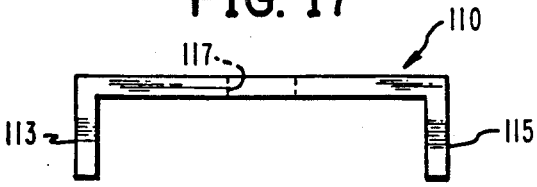
Figure 19:
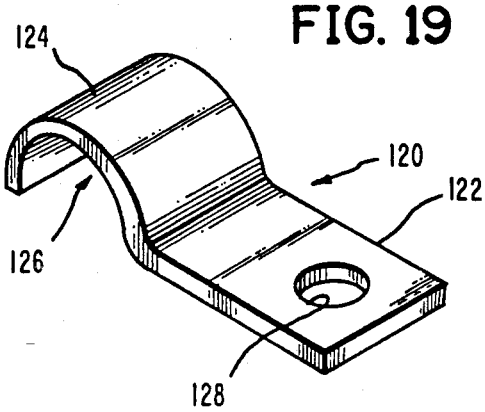
Figure 22:
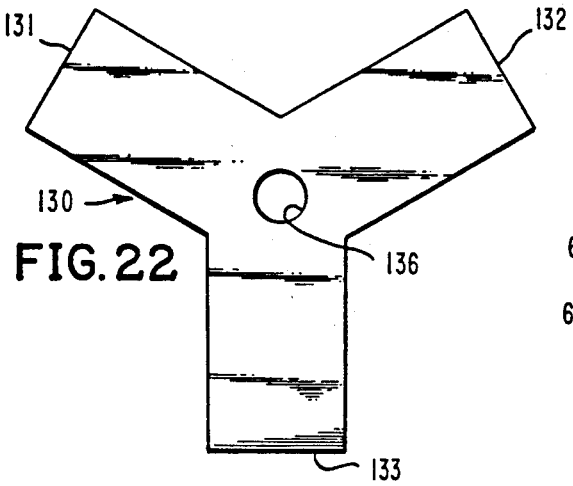
FIG. 22 is an alternate embodiment flat metal wire mesh engaging member comprising in combination with the metal nail-like member of FIG. 6 an alternate embodiment of the metal fastening apparatus of the present invention.

In FIG. 14, the metal wire mesh engaging member is indicated by general numerical designation 80 and is comprised of a pair of crossed, flat metal members 82 and 84 oriented at a right angle with respect to each other and suitably secured together such a by welding. In FIG. 15, the metal wire mesh engaging member is indicated by general numerical designation 90 and includes a metal member 91 provided with an upwardly extending indentation 92 for partially encircling a strand 41 (FIG. 3) of the metal wire mesh 40 (FIG. 3) with the metal member 90 being provided at its opposite end portions with holes 93 and 95 for receiving metal nail-like members 74 (FIG. 6). In FIGS. 16 and 17, FIG. 16 being a top view and FIG. 17 being a side elevational view, alternate embodiment metal wire mesh engaging member 110 is shown which includes a metal member 111 having its opposed end portions 113 and 115 extending downwardly at right angles with respect to the main portion of the metal member 111 as may be best seen in FIG. 17. The metal member 111 is provided with a centrally formed hole 117 for receiving the metal nail-like member 74 (FIG. 6) to fasten the metal wire mesh engaging member 110 to a metal pole such as metal pole 30 of FIG. 3. Upon such fastening, the downwardly extending portions 113 and 115 engage one or more of the strands 41 (FIG. 3) of the metal wire mesh 40 to fasten the metal wire mesh to the metal pole. The further alternate embodiment of metal wire mesh engaging member is illustrated in FIGS. 18 and 19 and is identified by general numerical designation 120. The member 120 includes a flat end portion 122 and an upwardly curved end portion 124 providing an upwardly extending indentation indicated by general numerical designation 126. The flat end portion 122 is provided with a hole 128 for receiving a metal nail-like member such as member 74 of FIG. 6 for fastening the metal wire mesh engaging member 120 to a metal pole, such as pole 30 of FIG. 3, with the indentation 126 engaging at least one one of the metal strands 41 (FIG. 3) of the metal wire mesh 40 (FIG. 3) to fasten the metal wire mesh 40 to a metal pole. A similar flat metal wire mesh engaging member indicated by general numerical designation 130 is illustrated in FIG. 22 and, as shown, is generally Y-shaped. The Y-shaped structure is comprised of integrally formed metal legs 131, 132 and 133 which may be formed, such as for example, by stamping from a suitable metal plate or sheet. The member 130 is provided with a central hole 136 for receiving a metal nail-like member such as member 74 of FIG. 6 to fasten the metal wire mesh engaging member 130 to a metal pole with the legs 131, 132 and 133 engaging one or more of the metal strands 41 (FIG. 3) to fasten metal wire mesh 40 (FIG. 3) to a metal pole, e.g. metal pole 30 of FIG. 3.

Reference is now made to FIGS. 20, 21 and 23–25 wherein further alternate embodiments of the generally semi-hemispherical shell-like member member 62 shown in FIGS. 5 and 7 are illustrated. It will be further understood that these alternate embodiments embody the present invention and comprise metal fastening apparatus of the present invention in combination with the metal nail-like member 74 shown in FIGS. 6 and 7. Such combination may further include one or more of the plastic washers 84 and 86 of FIG. 7.

As with the alternate embodiments of FIGS. 8–10, structures in FIGS. 20, 21, and 23–25 are substantially the same as the structure of the generally semi-hemispherical shell-like metal member 62 of FIGS. 6 and 7 and for convenience of reference are given the same numerical designations plus additional alphabetical designation.

Figure 20:
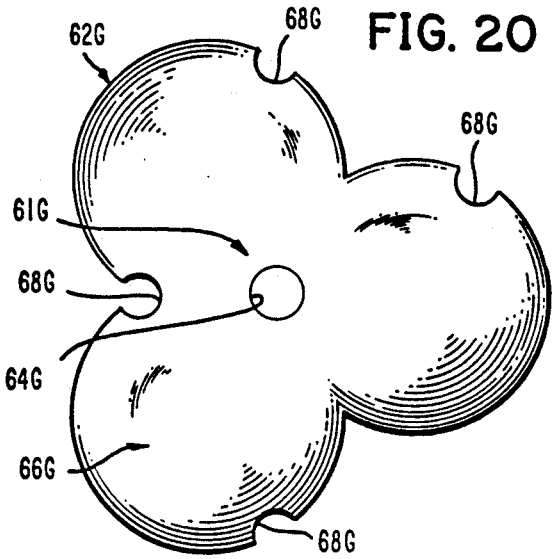
FIGS. 20, 21 and 23–25 are further top views of alternate embodiments of metal skirt members comprising alternate embodiments of metal fastening apparatus of the present invention and also for use in combination with the metal nail-like member of FIG. 6.

Referring specifically to FIG. 20, there is illustrated an alternate generally semi-hemispherical shell-like metal member 62G which is of generally clover leaf shape in top view as shown in FIG. 20. The top central portion 61G of member 62G is provided with a hole 64G for receiving a metal nail-like member such as member 74 of FIG. 6 and is further provided with a plurality of inwardly extending indentation 68G for at least partially encircling and engaging metal strands 41 (FIG. 3) of metal wire mesh 40 (FIG. 3) to fasten the metal wire mesh to a metal pole, such as pole 30 of FIG. 3, upon the metal nail-like member 74 being inserted through the hole 64G and driven into the metal pole.

Figure 21:
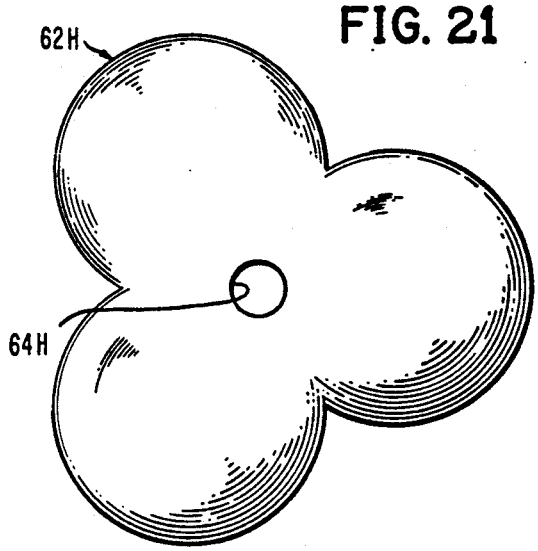

In FIG. 21 the generally semi-hemispherical shell-like metal member indicated by general numerical designation 62H is substantially the same as member 62G of FIG. 20 but does not include any indentation 62G (FIG. 20). Member 62H functions substantially the same as member 62D of FIG. 11 as described above to fasten metal wire mesh to a metal pole.

Figure 23:
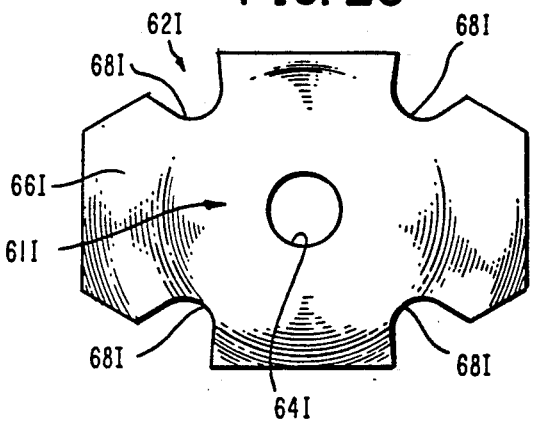
Figure 24:
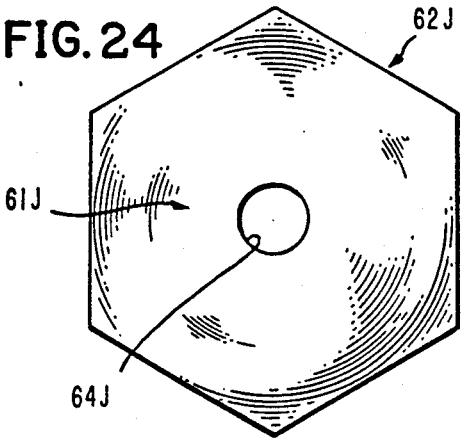
Figure 25:
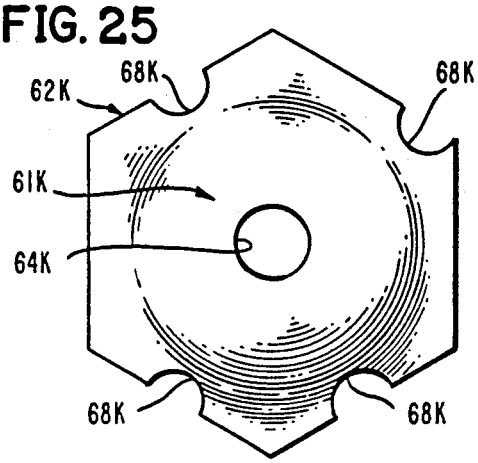

The alternate embodiments of generally semi-hemispherical shell-like metal members shown in FIGS. 23–25 are given general numerical designations 62I, 62J and 62K as shown in the FIGS. Structure in these FIGS., similar to structure in the earlier described FIGS. showing the generally semi-hemispherical shell-like metal members, are given similar numerical designations plus the additional alphabetical designations as shown, and such structure, it will be understood, performs the same function as described above for engaging at least one of the metal strands 41 (FIG. 3) to fasten metal wire mesh 40 (FIG. 3) to a metal pole such as pole 30 of FIG. 3; member 62J of FIG. 24 functions substantially the same as member 62D of FIG. 11, except that in top view member 62J as shown in FIG. 24 is polygonal instead of circular as shown in FIG. 11.

Figure 26:
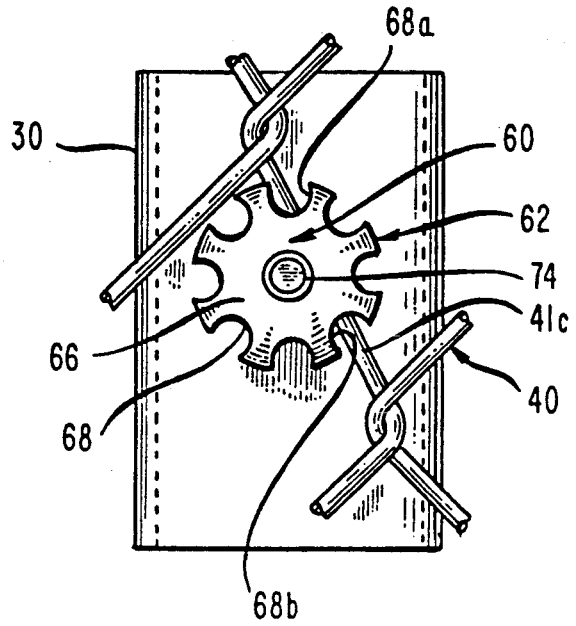
FIG. 26 is a view similar to FIG. 3 but showing the alternate embodiment of the metal fastening apparatus of the present invention illustrated in FIGS. 5–7 fastening metal wire mesh to a metal pole.

Referring now to FIG. 26, the alternate embodiment metal fastening apparatus indicated by general numerical designation 60 of FIGS. 5–7 is shown fastening the metal wire mesh 40 to metal pole 30 upon the shank 78 (FIGS. 6 and 7) of the metal nail-like member 74 (FIG. 6) being driven into the metal pole 30. It will be understood that upon the metal nail-like member 74 being driven into the metal pole 30 adjacent the straight length of strand 41C of the metal wire mesh 40, pair of generally inwardly and upwardly extending indentations **68*a* and 68*b* provided in the downwardly extending skirt portion 66 of the generally semi-hemispherical shell-like metal member 62 partially encircle the straight length of metal wire strand 41*c* to fasten the metal wire mesh 40 to the metal pole 30. Referring again to FIG. 3, it will be noted that upon the shank 22 (FIG. 2) of the metal nail-like member 20 being driven into the metal pole 30 adjacent the strands of metal wire 41*c* and 41*d* of the metal wire mesh 40, a first pair of indentations 18*a* and 18*b* partially encircle the strand of metal wire 41*c* and a second pair of indentations 18*c* and 18*d* partially encircle the strand of metal wire 41*d* to fasten the metal wire mesh 40 the metal pole 30, it being understood, as taught above, that the alternate embodiment metal fastening apparatus shown in FIGS. 5–7 may be used to fasten the metal wire mesh 40 to the metal pole 30, FIG. 3, in the same manner as the metal fastening apparatus embodiment 10 of FIGS. 2 and 3 and in so fastening the correspondingly located indentations in the downwardly extending skirt portion 66 (FIG. 5) would partially encirle the strands of metal wire 41*c* and 41*d* and fasten the metal wire mesh 40 to the metal pole 30**.

Figure 27:
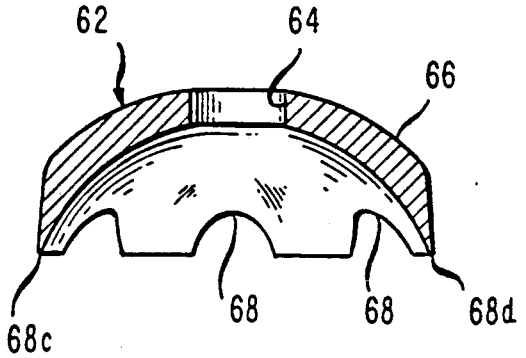
FIG. 27 is a cross-sectional view taken generally along the line 27—27 in FIG. 5.

Referring now to FIG. 27, it will be further understood that the peripheral edge portions **68*c* and 68*d*, FIG. 5, intermediate the indentations 68 may terminate downwardly in a chisel edge as shown in FIG. 27 or, as shown in cross-section in FIG. 27, may terminate downwardly in cross-section substantially in a point. It has been found that by terminating the peripheral edge portions e.g. 68*c* and 68*d*, of the downwardly extending skirt portion 66 intermediate the indentations 68 in a chisel edge or substantially at a point in cross-section, such peripheral edge portions at least slightly embed into the metal pole 30 upon the metal nail-like member 74 being driven therein and make it further difficult to remove the metal fastening apparatus of the present invention from the metal pole and thereby make it further difficult to remove the metal wire mesh 40 from the metal pole 30** upon being fastened thereto.

Figure 28:
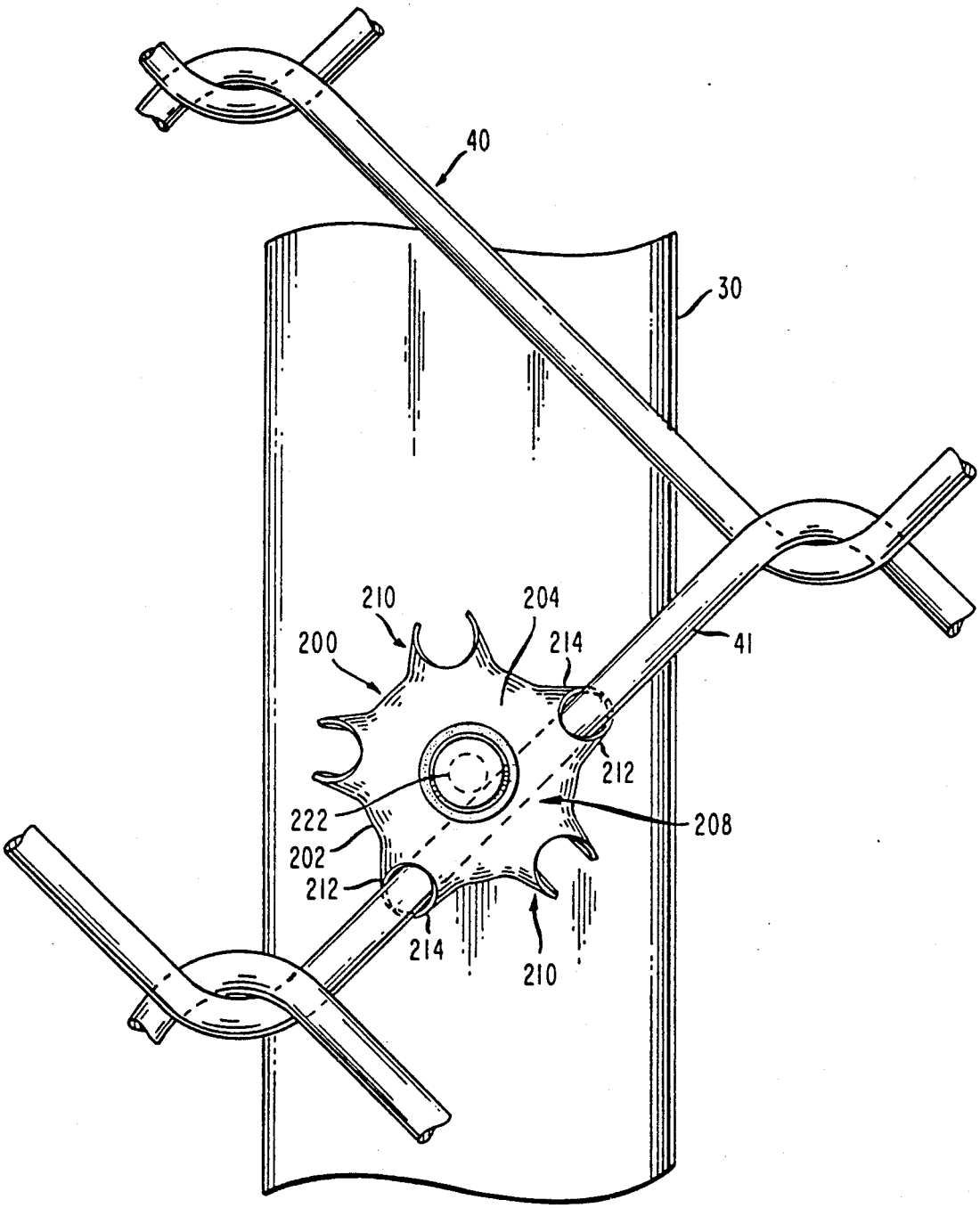
FIG. 28 is a generally front elevational view of an alternate embodiment of metal fastening apparatus embodying the present invention and showing such apparatus fastening metal wire mesh to a metal pole.

A further alternate embodiment of metal fastening apparatus or metal wire mesh engaging member of the present invention is shown in FIGS. 28–30 and indicated by general numerical designation 200. Member 200 is for engaging at least one straight strand of metal wire, for example straight strand 41 shown in FIG. 28, to fasten the metal wire mesh 40 to the metal pole 30. The metal wire mesh engaging member 200 includes a generally semi-hemispherical shell-like metal member 202 including a top central portion 204 (FIG. 30) provided with a hole 206 (FIG. 30) extending therethrough and a downwardly extending skirt portion 208 provided with a plurality of generally radially outwardly extending portions each indicated by general numerical designation 210; portions 210 are spaced circumferentially around the skirt portion 208 as may be best seen in FIG. 29.

Each portion 210, note particularly FIG. 29, includes a pair of curved and downwardly extending spaced apart members 212 and 214. As may be further best understood from FIG. 29, each portion 210 and included pair of downwardly extending members 212 and 214 is generally in the shape of a semi-circle to provide indentations 216 for receiving a portion of a straight length of one of the strands of metal wire such as strand 41. It will be noted from the bottom portion of FIG. 29 that such semi-circle providing the indentations 216 has an included angle greater than 180°, and in a preferred embodiment has an included angle α of about 200° to about 220°. It will be further understood from the bottom portion of FIG. 29 that the distance W between the downward terminal portions of the members 212 and 214 is greater than the diameter D of a strand of metal wire, e.g. strand 41, to permit generally diametrically opposed (FIG. 28) pairs of downwardly extending members 212 and 214 to be placed around portions of a straight length of one of the strands of metal wire such as strand 41.

Further, the metal fastening apparatus alternate embodiment shown in FIGS. 28–29, note FIG. 30 in particular, includes a metal nail-like member indicated by general numerical designation 220 and which includes a shank 222 for being inserted downwardly through the hole 206 provided in the top portion 204 of the metal member 202 and is for extending downwardly generally centrally interiorly of the skirt portion 208. Metal nail-like member 220 includes a head 224 larger than the hole 206 and the shank 222 may be provided with scoring producing outwardly extending ridge 226 for resisting removal of the shank 222 from the metal pole 30 (FIG. 28) upon the shank being driven therein. The metal fastening apparatus of this embodiment may further include a plastic washer 230 for encircling the upper portion of the shank 222 and for being positioned between the head 224 of the metal nail-like member 220 and the top central portion 204 of the member 202.

To fasten the metal wire mesh 40 to the metal pole 30, and referring again generally to FIG. 28, upon two pairs of generally diametrically opposed pairs of outwardly extending members 212 and 214 being placed around portions of a straight length of strand 41 of the metal wire mesh 40 as shown in FIG. 28, and upon the shank 222 being inserted downwardly through the hole 206 (FIG. 30) and the shank 222 being driven into the metal pole 30, the two pairs of pairs of downwardly extending members 212 and 214 placed over the strand 41 are deformed and wrapped around and substantially totally encircle the straight length of strand 41, note FIG. 30, to fasten the metal wire mesh 40 to the metal pole 30 as shown in FIG. 1.

In summary, it will be understood that by providing the pairs of curved and downwardly extending spaced apart members 212 and 214 and the outwardly extending portions 210 with the semi-circular shape having an included angle α greater than 180°, that upon the metal nail-like member 220 being driven into the metal pole, the pairs of curved and downwardly extending members 212 and 214 placed around portions of strand 41 of metal wire are deformed and wrapped around a strand of metal wire, e.g. strand 41, FIG. 28, and such pairs of members 212 and 214 substantially totally encircle the strand of metal wire 41, as shown in FIG. 30, thereby securely fastening the metal wire mesh 40 to the metal pole and making it extremely difficult to unfasten the metal wire mesh from the metal pole.

It will be understood by those skilled in the art that many modifications and variations may be made in the present invention without departing from the spirit and the scope thereof.

What is claimed is:

1. Fastening apparatus for fastening metal wire mesh to a metal pole, said metal wire mesh made of interwoven strands of metal wire of generally circular cross-section and including a plurality of straight lengths of said strands of metal wire, comprising:

a metal wire mesh engaging member comprising a generally semi-spherical shell-like member including a downwardly extending skirt portion provided with a plurality of generally inwardly and upwardly extending generally semi-spherical indentations and a top central portion provided with a hole formed generally centrally thereof, said skirt portion provided with a plurality of generally radially outwardly extending portions spaced circumferentially therearound, each portion including a pair of curved and downwardly extending spaced apart members and each portion and included pair of downwardly extending members being generally in the shape of a semi-circle to provide one of said indentations for receiving a straight length of said strands of metal wire, said semi-circle having an included angle greater than 180°, said strands of metal wire having a diameter and said pairs of downwardly extending members including downward terminal portions spaced apart a distance greater than said diameter of said strands to permit said pairs of downwardly extending members to be placed around said straight lengths of said strands of metal wire;

a metal nail-like member including a shank for being inserted downwardly through said hole, said metal nail-like member including a head larger than said hole and said shank provided with resistance means for resisting removal of said shank from said pole upon being driven therein; and upon two generally diametrically opposed pairs of said pairs of downwardly extending members being placed around portions of one of said straight lengths of said strands of metal wire mesh, and upon said shank being inserted downwardly through said hole generally centrally interiorly of said skirt portion and being driven into said metal pole, said two pairs of downwardly extending members being deformed and wrapped around and substantially totally encircling said one of said straight lengths of strands of metal wire to fasten said metal wire mesh to said metal pole; and said metal wire mesh engaging member made of a predetermined metal sufficiently strong to maintain said strands of metal wire fastened to said metal pole upon said shank being driven into said metal pole.

2. Fastening apparatus according to claim 1 wherein said removal resisting means comprise outwardly extending barbs provided on said shank.

3. Fastening apparatus according to claim 1 wherein said removal resisting means comprise outwardly extending ridges.

4. Fastening apparatus according to claim 1 wherein said skirt portion is provided with a plurality of radially disposed and upwardly extending ribs for structurally reinforcing said skirt portion.

5. Fastening apparatus according to claim 1 wherein said skirt portion is provided with a plurality of upwardly extending and concentrically disposed ribs for structurally reinforcing said skirt portion.

6. Fastening apparatus according to claim 1 wherein said skirt portion is provided with a plurality of radially disposed generally longitudinally extending holes for enhancing deformation of said skirt portion to thereby enhance the engagement of said skirt portion with said metal wire mesh to enhance the fastening thereof to said metal pole.

7. The fastening apparatus according to claim 1 wherein said included angle is from about 200° to about 220°.

8. Fastening apparatus for fastening metal wire mesh to a metal pole, said metal wire mesh made of interwoven strands of metal wire of generally circular cross-section and including a plurality of straight lengths of said strands of metal wire, comprising:

a metal wire mesh engaging member comprising a generally semi-spherical shell-like member including a top central portion provided with a hole formed generally centrally thereof and a downwardly extending skirt portion provided with a plurality of generally radially outwardly extending portions spaced circumferentially around said skirt portion, each portion including a pair of curved and downwardly extending spaced apart members and each portion and included pair of downwardly extending members being generally in the shape of a semi-circle to provide an indentation for receiving a portion of a straight length of said strands of metal wire, said semi-circle having an included angle greater than 180°;

said strands of metal wire having a diameter and said pairs of downwardly extending members including outward terminal portions spaced apart a distance greater than said diameter of said strands to permit said pairs of downwardly extending members to be placed around said straight lengths of said strands of metal wire;

a metal nail-like member including a shank for being inserted downwardly through said hole, said metal nail-like member including a head larger than said hole and said shank provided with resistance means for resisting removal of said shank from said pole upon being driven therein; and upon two generally diametrically opposed pairs of said pairs of downwardly extending members being placed around portions of one of said straight lengths of said strands of metal wire mesh, and upon said shank being inserted through said hole and being driven into said metal pole, said two pairs of said pairs of downwardly extending members being deformed and wrapped around and substantially totally encircling said one of said straight lengths of strands of metal wire to fasten said metal wire mesh to said metal pole.

9. Fastening apparatus according to claim 8 wherein said included angle is from about 200° to about 220°.

* * * * *